US008334249B2

(12) United States Patent
Belten-Casteel et al.

(10) Patent No.: US 8,334,249 B2
(45) Date of Patent: Dec. 18, 2012

(54) COATED DETERGENT COMPOSITION AND MANUFACTURE PROCESS

(75) Inventors: Sascha Belten-Casteel, Aachen (DE); Gerard Krist, Zwolle (NL); Stefan Müller, Köln (DE); Ralf Pörschke, Neckargemünd (DE)

(73) Assignees: Dalli-Werke GmbH & Co. KG, Stolberg (DE); Gelita AG, Eberbach (DE)

( * ) Notice: Subject to any disclaimer, the term of this patent is extended or adjusted under 35 U.S.C. 154(b) by 87 days.

(21) Appl. No.: 12/678,994

(22) PCT Filed: Sep. 10, 2008

(86) PCT No.: PCT/EP2008/007382

§ 371 (c)(1),
(2), (4) Date: Jun. 28, 2010

(87) PCT Pub. No.: WO2009/036914

PCT Pub. Date: Mar. 26, 2009

(65) Prior Publication Data

US 2010/0279914 A1 Nov. 4, 2010

(30) Foreign Application Priority Data

Sep. 19, 2007 (EP) ..... 07018340

(51) Int. Cl.

| | |
|---|---|
| ***C11D 11/00*** | (2006.01) |
| ***C11D 17/00*** | (2006.01) |
| ***B05D 1/12*** | (2006.01) |
| ***B05D 3/00*** | (2006.01) |

(52) U.S. Cl. ..... 510/441; 510/446; 510/224; 510/298; 510/470; 510/473; 510/474; 510/475; 510/487; 427/462; 427/180; 427/189

(58) Field of Classification Search ..... 510/441, 510/446, 224, 298, 470, 473, 474, 475, 487; 427/462, 180, 189

See application file for complete search history.

(56) References Cited

U.S. PATENT DOCUMENTS

| | | | | |
|---|---|---|---|---|
| 5,000,978 | A * | 3/1991 | Davidson et al. | 427/475 |
| 5,133,892 | A * | 7/1992 | Chun et al. | 510/224 |
| 6,407,052 | B2 * | 6/2002 | Gassenmeier et al. | 510/441 |
| 6,462,007 | B1 * | 10/2002 | Pieroni et al. | 510/224 |
| 6,498,135 | B1 * | 12/2002 | Angell et al. | 510/441 |
| 6,797,686 | B2 * | 9/2004 | Romero et al. | 510/441 |
| 6,812,200 | B2 * | 11/2004 | Weber et al. | 510/441 |
| 2002/0010123 | A1 * | 1/2002 | Schmiedel et al. | 510/446 |
| 2002/0173440 | A1 * | 11/2002 | Chapple et al. | 510/302 |
| 2003/0100461 | A1 * | 5/2003 | Catlin et al. | 510/220 |
| 2003/0113445 | A1 * | 6/2003 | Martin | 427/180 |
| 2003/0211229 | A1 * | 11/2003 | Reeves et al. | 427/2.14 |
| 2004/0014631 | A1 | 1/2004 | Weber et al. | |
| 2005/0085403 | A1 * | 4/2005 | Larsen et al. | 510/375 |
| 2007/0184184 | A1 * | 8/2007 | Green et al. | 427/189 |
| 2007/0299196 | A1 * | 12/2007 | Ohkoshi et al. | 524/517 |

FOREIGN PATENT DOCUMENTS

| | | | |
|---|---|---|---|
| EP | 1360271 | B1 | 10/2004 |
| GB | 2402895 | A * | 12/2004 |
| WO | WO 96/35413 | A1 * | 11/1996 |
| WO | 99/51715 | | 10/1999 |
| WO | 02/49771 | A1 | 6/2002 |
| WO | 02/051976 | A1 | 7/2002 |
| WO | 02/097025 | A1 | 12/2002 |
| WO | WO 2006/057241 | A1 * | 6/2006 |

* cited by examiner

*Primary Examiner* — Lorna M Douyon
(74) *Attorney, Agent, or Firm* — Knobbe, Martens, Olson & Bear, LLP

(57) ABSTRACT

The present invention relates to a coated detergent composition and a process of manufacturing thereof. More in detail the present invention refers to a coated detergent tablet wherein the coating is applied to the tablet by bringing a powder coating material in direct contact with the tablet and thereafter equalizing the powder particles in a way that a homogenous "fused" coating (film) layer is obtained.

15 Claims, No Drawings

COATED DETERGENT COMPOSITION AND MANUFACTURE PROCESS

This application is the U.S. National Phase of International Application No. PCT/EP2008/007382, filed Sep. 10, 2008 designating the U.S., and published in English as WO 2009/036914 on Mar. 26, 2009, which claims priority to European Patent Application No. 07018340.5, filed Sep. 19, 2007.

The present invention relates to a coated detergent composition and a process of manufacturing thereof. More in detail the present invention refers to a coated detergent tablet wherein the coating is applied to the tablet by bringing a powder coating material in direct contact with the tablet and thereafter equalizing the powder particles in a way that a homogenous "fused" coating (film) layer is obtained.

In the art there is an ongoing interest in coated detergent tablets for the reason that detergent compositions having e.g. a high pH shall not come in direct contact with the skin of users. The coating of the tablets commonly is applied by contacting a liquid or solution of the coating material with the surface of the tablet e.g. by spraying, dipping, rolling or similar and thereafter drying the coated tablet.

EP-A 1 360 271 describes the coating of a detergent tablet wherein the tablets are transported on a conveyor belt having holes and the coating material is pressed through said holes to contact the bottom surface of the tablet, at the same time the tablets are transported through a curtain of coating material to contact the upper surface of the tablet with the coating material.

The object of the present invention was to provide a coated detergent tablet, wherein said tablet should be prepared by an efficient process resulting in a homogenous coating protecting the components of the tablet as well as the users skin.

This object is met by a method for preparing a coated detergent tablet, comprising the steps as follows:

(b) providing a powder of coating material comprising at least one film forming material and/or at least one low molecular sugar comprising 1 to 10 sugar units or any amino acid, preferably natural amino acids or a mixture of sugars, a mixture of amino acids or a mixture of sugars and amino acids;

(c) bringing said powder in direct contact with a detergent tablet by electrostatically charging the powder, and (d) applying energy and/or moisture/steam to the tablet coated with said powder, wherein the film forming material is selected from A.) at least one water soluble or dissolvable polymer selected from:

A1) a protein or a peptide having a molecular weight of 20,000 to 350,000 g/mol, preferably from 100,000 to 300,000 g/mol;

A2) sugar polymers like cellulose, starch, starch derivatives, pectines like glycogene or dextrine, A3) shellac, preferably degreased;

A4) polyvinyl alcohol.

In the following any detergent and/or additive compositions will be encompassed by the term "detergent". This detergent composition may be in the form of granules or of any non particulate solids such as bars or tablets or briquettes. The word "tablet" encompasses in the following any form of non particulate solids. Said tablet may have any shape. Preferably, said solid detergent tablet is formed in a shape to ensure the uniform dissolution of the tablet in the wash liquor. According to one preferred embodiment of the present invention the detergent and/or additive composition may comprise any ingredients known in the art for dish washing, laundry or water softening. Such ingredients may include for example surfactants, suds suppressers, bleach systems, chelating agents, builders, enzymes, fillers and perfumes, however, is not limited to these.

One particular preferred embodiment of the present invention is a shaped body for automatic dishwashing formed of a particulate detergent composition, wherein the detergent composition comprises any of the ingredients which are typical for such compositions. Such ingredients are not limiting the invention.

According to the present invention, a predosed quantity of detergent is coated with a water soluble or dissolvable material to provide a coated detergent tablet as a "unit coated detergent". The wording "unit coated detergent" means an amount of detergent suitable for one wash. Nevertheless, two or more unit coated detergents according to the present invention may be used in a single wash to meet different washing conditions, like dirtiness of washing, amount of washing, volume of washing machine, hardness of water, temperature of water and type of detergent. Said coating is made of a water or temperature dissolvable material. The unit coated detergent according to the present invention may contain between 2 grams and 100 grams of detergent, wherein the commonly used detergent tablet have usually a weight in the range of 5 to 60 g.

This unit coated detergent of the present invention is placed in the machine without any further handling step. This is possible, since said coating is made of a water solvable, dissolvable or dispersible material. Providing the detergent in coated form has several advantages. First, said unit coated detergent prevents wasting through spillage of the detergent and/or additive composition. Spillage may occur during the measuring and/or dispensing into the dispenser of the washing machine or into a dispensing device. Second, said unit coated detergent eliminates the need for the user to estimate the dosage of said composition required and ensures that the correct dosage of said composition per wash cycle is used by the user.

Step (b): Providing Powder of Coating Material

According to the invention in one step the detergent tablet is at least partially coated with a coating material in form of a powder. Said powder can be of any material which can be transferred into a homogenous coating. Suitable materials preferably used are mentioned below. Said material is contacted with the detergent tablet and thereafter is transferred into a homogenous "fused" (film) layer. In a preferred embodiment the powder involves properties enabling the powder to adhere efficiently to the detergent tablet. Such properties may be e.g. stickiness of the powder or of powder components, charge of the powder material or similar (dipole moment), however, as well non-sticky and uncharged powder material can be used e.g. in case the tablet itself has or is prepared with a somewhat sticky surface. Therefore, the powder coating material must not necessarily be charged, but can be used as uncharged material, however, preferably the detergent tablet according to the invention is at least partially coated with an electrostatically charged powder. A description of electrostatic charging can be found e.g. in Kirk-Othmer Encyclopedia of Chemistry Technology, 4th Edition.

The powders herein are preferably charged by acquiring a static charge from another charged object by induction. This is accomplished by direct charging, where the powder comes in contact with a conductor (electrode) at high voltage and an electrical charge, usually negative, is placed on the powder before atomization Typically, an external voltage source of 20-125 kV, preferably 30-100 kV, is used. A voltage gradient is established between the vicinity of the atomizer and the detergent tablet by using the charged coating particles, charged metal atomizer, or an electrode near the atomizer as a local source of a high voltage field. An electrostatic force is exerted on each powder particle equal to the product of the charge it carries and the field gradient. The trajectory of the particle is determined by all the forces exerted on the particle. These forces include momentum, drag, gravity, and electrostatics. The field lines influencing the coating particles are very similar in arrangement to the alignment of iron particles when placed between two magnets. Using this method, powder particles that would normally pass alongside the detergent material are attracted to it, and it is possible to coat part or all of the back side of the detergent tablet.

The key parameters which define whether a powder is suitable for electrostatic spray coating are Chargeability and Charge Relaxation Time. Chargeability is measured in Coulombs/kg and indicates the charge level which can be achieved for the powder. A powder with a chargeability of $1\times10^{-6}$ C/kg or more is considered suitable for electrostatic spray coating. Charge relaxation time is measured in seconds (s) and indicates how quickly a powder loses a charge. Less than 0.1 s is considered a fast charge relaxation time, more than 100 s is considered slow.

Electrostatic properties of powders are typically determined by professional laboratories, such as e.g. Chilworth Technologies of Southampton, UK.

Preferred powders have an average particle size of from 0.5 μm to 500 μm, preferably from 1 μm to 350 μm, more preferred from 5 to 250 μm. Particle size can be determined with a Laser Diffraction based Particle Size Analyzer "Mastersizer™ Type S Long Bed 2.18" of Malvern Instruments, Malvern, England. This device uses laser diffraction technology to determine particle sizes and particle size distributions of fine powders. A small powder sample is fluidized with dry compressed air and conveyed through a screen into a detection cell where it is exposed to a laser light beam. The pattern of laser light scattering is characteristic for a particle size distribution. The Malvern software analyzes this pattern based on spherical particles and presents the result in the form of a Particle Diameter Histogram. The software also calculates the parameter D(v,50) which is the particle size at which 50% of the sample is smaller and 50% is larger than this size. This parameter is also known as the mass median diameter (MMD).

It is preferred that the absolute particle density of the powder be from 100 g/l to 2,000 g/l as measured by Helium Pyconometry. Pyconometers measure density by calculating the difference in weight between the full and empty pycnometer and its known volume. For the purposes of the present invention the measurements can be made on an Accupyc 1330 Pycnometer (available from Micronerities, Norcross, Ga., USA).

Any suitable powder or mixtures of powders may be used herein. In the preferred embodiments the powder coating material comprises A.) at least one water soluble or dissolvable polymer selected from:

A1) a protein (more than 100 amino acids up to "full length proteins" e.g. up to 2500 amino acids) or a peptide having at least 10, preferably at least 50, more preferred at least 80 m most preferred at least 100 amino acids. Alternatively the protein or peptide has a molecular weight of 20,000 to 350,000 g/mol, preferably from 100,000 to 300,000 g/mol. The most preferred protein is gelatine or a peptide thereof. Enzymes in their active form are not preferred.

A2) sugar polymers like cellulose, starch, starch derivatives, pectines like glycogene or dextrine.

A3) shellac, preferably degreased.

A4) polyvinyl alcohol

The coating may consist essentially of one of these polymers or of a mixture of at least two of these.

B.) low molecular sugars comprising 1 to 10 sugar units or any amino acid, preferably natural amino acids or a mixture of sugars, a mixture of amino acids or a mixture of sugars and amino acids. The coating may consist essentially of these compounds.

C.) a mixture of compounds mentioned in A.) and B.), particularly of compounds mentioned in A1.) and B.)

D.) a mixture of compounds mentioned in A.), B.) or C.) with further homo- and/or blockcopolymers.

E.) a blend of compounds mentioned in A.), B.), C.) or D.) with compounds either non-ionic, amphoter, anionic or cationic like a shellac type polyethyleneglycole (PEG)

poly(meth)acrylic acid (co)polymers vinylacetate quaternized polyvinylalcohole or derivatives thereof.

F.) a blend of compounds mentioned in A.), B.), C.), D.) or E.) with compounds either non-ionic, amphoter, anionic or cationic like a) water-soluble nonionic polymers from the group of a1) polyvinyl pyrrolidones, a2) vinyl pyrrolidone/vinyl ester copolymers, a3) cellulose ethers b) water-soluble amphoteric polymers from the group of b1) alkyl acrylamide/acrylic acid copolymers, b2) alkyl acrylamide/methacrylic acid copolymers, b3) alkyl acrylamide/methyl methacrylic acid copolymers, b4) alkyl acrylamide/acrylic acid/alkylaminoalkyl(meth) acrylic acid copolymers, b5) alkyl acrylamide/methacrylic acid/alkylaminoalkyl (meth)acrylic acid copolymers, b6) alkyl acrylamide/methyl methacrylic acid/alkylaminoalkyl(meth)acrylic acid copolymers, b7) alkyl acrylamide/alkyl methacrylate/alkylaminoethyl methacrylate/alkyl methacrylate copolymers, b8) copolymers of b8i) unsaturated carboxylic acids, b8ii) cationically derivatized unsaturated carboxylic acids, b8iii) optionally other ionic or nonionic monomers, c) water-soluble zwitterionic polymers from the group of c1) acrylamidoalkyl trialkylammonium chloride/acrylic acid copolymers and alkali metal and ammonium salts thereof, c2) acrylamidoalkyl trialkylammonium chloride/methacrylic acid copolymers and alkali metal and ammonium salts thereof, c3) methacroyl ethyl betaine/methacrylate copolymers, d) water-soluble anionic polymers from the group of d1) vinyl acetate/crotonic acid copolymers, d2) vinyl pyrrolidone/vinyl acrylate copolymers, d3) acrylic acid/ethyl acrylate/N-tert.-butyl acrylamide terpolymers, d4) graft polymers of vinyl esters, esters of acrylic acid or methacrylic acid individually or in admixture copolymerized with crotonic acid, acrylic acid or methacrylic acid with polyalkylene oxides and/or polyalkylene glycols, d5) grafted and crosslinked copolymers from the copolymerization of d5i) at least one monomer of the nonionic type, d5ii) at least one monomer of the ionic type, d5iii) polyethylene glycol and d5iv) a crosslinking agent, d6) copolymers obtained by copolymerization of at least one monomer of each of the following three groups:

d6i) esters of unsaturated alcohols and short-chain saturated carboxylic acids and/or esters of short-chain saturated alcohols and unsaturated carboxylic acids, d6ii) unsaturated carboxylic acids, d6iii) esters of long-chain carboxylic acids and unsaturated alcohols and/or esters of the carboxylic acids of group d6ii) with saturated or unsaturated, linear or branched $C_{8-18}$ alcohols, d7) terpolymers of crotonic acid, vinyl acetate and an allyl or methallyl ester, d8) tetrapolymers and pentapolymers of d8i) crotonic acid or allyloxyacetic acid, d8ii) vinyl acetate or vinyl propionate, d8iii) branched allyl or methallyl esters, d8iv) vinyl ethers, vinyl esters or straight-chain allyl or methallyl esters, d9) crotonic acid copolymers with one or more monomers from the group consisting of ethylene, vinyl benzene, vinyl methyl ether, acrylamide and water-soluble salts thereof, d10) terpolymers of vinyl acetate, crotonic acid and vinyl esters of a saturated aliphatic monocarboxylic acid branched in the α-position, e) water-soluble cationic polymers from the group of e1) quaternized cellulose derivatives, e2) polysiloxanes containing quaternary groups, e3) cationic guar derivatives, e4) polymeric dimethyl diallylammonium salts and copolymers thereof with esters and amides of acrylic acid and methacrylic acid, e5) copolymers of vinyl pyrrolidone with quaternized derivatives of dialkylaminoacrylate and methacrylate, e6) vinyl pyrrolidone/methoimidazolinium chlorid copolymers, e7) quaternized polyvinyl alcohol, e8) polymers known by the INCI names of polyquaternium 2, polyquaternium 17, polyquaternium 18 and polyquaternium 27.

All the compounds of F.) are described in detail in EP 1 173 539 B1.

The compositions mentioned under items A.) to F.) optionally can comprise a binder material.

In case of coating compositions A.) to C.) said compositions may comprise at least 5% by weight, preferably at least 15% by weight, more preferably at least 35% by weight, most preferably at least 50% by weight and particularly preferred at least 60% by weight and up to 100% by weight, or up to 95% by weight, up to 90% by weight or maybe up to 80% by weight of the materials mentioned in A.) to C.), wherein each of the materials can be contained in the described amount, resulting in a sum of 100% or in a sum of 95% or maybe in a sum of 90% or 80% of the coating. Preferred are the materials mentioned in A.) or B), particularly preferred the materials mentioned in A1) and/or B.). The materials mentioned in A), particularly the materials mentioned in A1) are mostly preferred as one of the main ingredient of the coating for the reason that the materials can provide a smooth and homogenous coating, are clearly non-toxic and can be easily and fast dissolved in water or in wash load, particularly in heated water/wash load like in an automatic dishwashing apparatus.

In one particularly preferred embodiment the coating material comprises at least 35% of at least one of the components of A.), preferably component A1) and at least 1% of one of the component B.), preferably at least one sugar. In another preferred embodiment the coating material comprises at least 80% of at least one of the components of A.), preferably component A1) as the only film forming component without the addition of any further components of the above cited list. In all embodiments, particularly in both of the preferred embodiments the coating material further can comprise a plasticizer as defined below.

In case of coating compositions D.) to F.) said compositions may comprise at least 5% by weight, preferably at least 15% by weight, more preferably at least 35% by weight, most preferably at least 50% by weight of the compounds mentioned in A.) to C.), preferably A1.) and/or B.) and 5 to 95, preferably 10 to 75, more preferably 15 to 50% by weight of at least one of the compounds mentioned in D.) to F.) as further compounds.

A preferred water soluble low molecular weight compound is any type of peptide or any type of sugar or amino acid.

One particular advantage of these materials is on one side the water solubility/dispersibility on the other hand the non-toxicity of the compounds.

When used as a material for the formation of a water soluble/dispersible coating use of gelatine, cellulose, starch, pectine, dextrine and/or low molecular sugar or amino acid compounds as the water soluble/dissolvable/dispersible material has been found to be particularly suitable, specifically by displaying a very short dissolution/dispersion time, by being harmless (common ingredients of food) and also by producing a very low amount of remains in use. On the other hand the use of said materials provides a very high speed preparation process.

When referring to the material, water-soluble/dissolvable/dispersible is herein defined when more than 99% of a coating (layer) of such material dissolves within 15 minutes, preferably within 10 min in a beaker containing 1 L of deionised water at 40° C. which is stirred with a stirrer revolving at 200 r.p.m. It is pointed out that materials can be used as ingredients for the coating which itself may not be soluble, but e.g. dispersible, as long as the coating comprising said material is dissolved by water.

The preferred water soluble/dissolvable/dispersible materials are cellulose, particularly preferred cellulose fibres or microcristalline cellulose; starch or starch derivatives, pectine like glycogene or—most preferred—proteins or peptides (at least 10 mer), particularly gelatine or derivatives or peptide fragments thereof. All the mentioned materials preferably are used in powder form having an average particle size in dry state of below 1000 μm, preferably below 500 μm, more preferred 250 μm or smaller and particularly preferred of between 20 and 200 μm. It is particularly preferred that more than 80% of the powder particles have a particle size of smaller than 200 μm.

Another suitable and preferred material is shellac, which preferably is used in degreased form. Further suitable compounds are "low molecular weight compounds" like $C_3$-$C_6$ sugars in aldose or ketose form like allose, altrose, glucose, mannose, gulose, idose, galactose, talose, psicose, fructose, sorbose, tagatose, xylulose, ribulose, ribose, arabinose, xylose, lyxose, threose, erythrose, erythrulose, dihydroxy acetone or glycerol aldehyde or disaccharides like for example saccharose, lactose, maltose or Isomalt or oligosaccharides comprising 3 to 10 sugar units or amino acids, preferably natural amino acids (commonly contained in natural proteins) without being restricted to the mentioned examples. One particularly preferred low molecular weight compound is the sugar Isomalt ST, comprising 6-O-α-D-glucopyranosyl-D-sorbite and 1-O-α-D-glucopyranosyl-D-mannite dihydrate units. Further information about said sugar is available under www.chemistryworld.de/preise/prs-html/analysen/2444-spz.htm.

Said materials can be used solely each or as a mixture of the single materials. In one preferred embodiment the mentioned material(s) of A.) to F.) can form one layer on the surface of the unit composition, in an alternative preferred embodiment the unit composition comprises at least two layers of the above mentioned materials, wherein the layers can comprise different material selected from A.) to F.), as well as different combinations of the material(s) of A.) to F.) as mentioned above.

In a preferred embodiment the water soluble coating system may contain a plasticizer with a content of at least 0.01%, preferably at least 0.1%, more preferred at least 0.5% and most preferred at least 1% and up to 30%, preferably up 20%, more preferred up to 15 wt %, or even more preferably about 10% or less of the coating.

Suitable types of plasticizers include solvents. In case water is used as at least one solvent plasticizer then the total content of the plasticizer can be up to 40%. The addition of a plasticizer may lower the brittleness and may decrease the shrinkage of the formed layer resulting in increased properties of the layer.

Preferred examples of such plasticizers include water, alkylene glycol mono lower alkyl ethers, wherein lower means $C_1$ to $C_6$, glycerol, polyalcohols, ethylene glycols, propylene glycols, polyethylene glycols, ethoxylated or propoxylated ethylene or propylene glycol or glycerol esters, glycerol triacetate, acyetylated mono glycerides, triethyl citrate, tributyl citrate, acetyl triethyl citrate, acetyl tributyl citrate, diethylphthalate, glycerol carbonate and propylene carbonate without being restricted to these.

One of the preferred types of plasticizers comprises the medium molecular weight polyethylene glycols (PEGs). Such materials preferably have molecular weights of at least 150. PEGs of molecular weight ranging from 200 to 3000 are most preferred. Yet another preferred type of plasticizers comprises lower molecular weight methyl esters. Such materials are those of the general formula: R—C(O)—$OCH_3$ wherein R ranges from 1 to 18. Examples of suitable lower molecular weight methyl esters include methyl acetate, methyl propionate, methyl octanoate, and methyl dodecanoate.

Further suitable types of plasticizers include nonionic surfactants.

Preferred nonionic surfactants incorporated into the resin provide a suds suppression benefit. The alkyl ethoxylate condensation products of an alcohol with from 1 to 80 moles of an alkylene (liner/branched aliphatic/aromatic optionally substituted $C_2$ to $C_{20}$ alkylene) oxide are suitable for this use. The alkyl chain of the alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol. In this regard Suitable surfactants include POLY-TERGENT® SLF-18B nonionic surfactants by Olin Corporation.

Ethoxylated $C_6$-$C_{18}$ fatty alcohols and $C_6$-$C_{18}$ mixed ethoxylated/propoxylated fatty alcohols are suitable surfactants for use herein. Preferably the ethoxylated fatty alcohols are the $C_{10}$-$C_{18}$ ethoxylated fatty alcohols with a degree of ethoxylation of from 3 to 50, most preferably these are the $C_{12}$-$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

The condensation products of ethylene oxide with a hydrophobic base formed by the condensation of propylene oxide with propylene glycol are suitable for use herein. The hydrophobic portion of these compounds preferably has a molecular weight of from 1500 to 1800 and exhibits water insolubility. Examples of compounds of this type include certain of the commercially-available Pluronic™ surfactants, marketed by BASF.

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from 2500 to 3000. Examples of this type of nonionic surfactant include certain of the commercially available Tetronic™ compounds, marketed by BASF.

In a preferred embodiment of the present invention the polymer system may comprises a mixed nonionic surfactant system.

Suitable compounds include fatty esters of mono- or polyhydric alcohols having from 1 to 40 carbon atoms in the hydrocarbon chain. The fatty acid portion of the fatty ester can be obtained from mono- or poly-carboxylic acids having from 1 to 40 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, Valerie acid, lactic acid, glycolic acid and beta,beta'-dihydroxyisobutyric acid. Examples of suitable polycarboxylic acids include: n-butyl-malonic acid, isocitric acid, citric acid, maleic acid, malic acid and succinic acid. The fatty alcohol radical in the fatty ester can be represented by mono- or polyhydric alcohols having from 1 to 40 carbon atoms in the hydrocarbon chain. Examples of suitable fatty alcohols include; behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan. Preferably, the fatty acid and/or fatty alcohol group of the fatty ester adjunct material has from 1 to 24 carbon atoms in the alkyl chain. Preferred fatty esters herein are ethylene glycol, glycerol and sorbitan esters wherein the fatty acid portion of the ester normally comprises a species selected from behenic acid, stearic acid, oleic acid, palmitic acid or myristic acid. The glycerol esters are also highly preferred. Specific examples of fatty alcohol esters for use herein include: stearyl acetate, palmityl all-lactate, cocoyl isobutyrate, oleyl maleate, oleyl dimaleate, and tallowyl proprionate. Fatty acid esters useful herein include: xylitol monopalmitate, pentaerythritol monostearate, sucrose monostearate, glycerol mono stearate, ethylene glycol mono stearate, sorbitan esters. Suitable sorbitan esters include sorbitan monostearate, sorbitan palmitate, sorbitan monolaurate, sorbitan monomyristate, sorbitan monobehenate, sorbitan mono-oleate, sorbitan dilaurate, sorbitan distearate, sorbitan dibehenate, sorbitan dioleate, and also mixed tallow alkyl sorbitan mono- and all-esters. Glycerol monostearate, glycerol mono-oleate, glycerol monopalmitate, glycerol monobehenate, and glycerol distearate are preferred glycerol esters herein. Further suitable agents include triglycerides, mono or diglycerides, and wholly or partially hydrogenated derivatives thereof, and any mixtures thereof. Suitable sources of fatty acid esters include vegetable and fish oils and animal fats. Suitable vegetable oils include soy bean oil, cotton seed oil, castor oil, olive oil, peanut oil, safflower oil, sunflower oil, rapeseed oil, grapeseed oil, palm oil and corn oil. Waxes, including microcrystalline waxes are possible lubricants, although much less preferred in the present invention due to their poor solubility in water. Preferred waxes have a melting point in the range from 35° C. to 110° C. and comprise generally from 12 to 70 carbon atoms. Preferred are petroleum waxes of the paraffin and microcrystalline type which are composed of long-chain saturated hydrocarbon compounds.

As a further component of the layer inorganic compounds can be included in the coating composition, like e.g. salts of aluminium or pigments like SiO2. Addition of inorganic materials can reduce stickiness of the formed layer and may increase the "fusion" or curing of the coating material.

A preferred embodiment of the present invention includes at least one coating material selected from the materials mentioned above under item A.), B.) or C.) and a plasticizer. Particularly it is preferred to mix a particulate protein material, preferably gelatine or peptides thereof optionally with a sugar as defined in B.) and with a plasticizer, preferably PEG, polyalcohol or glycerol, particularly preferred glycerol, to produce a sprayable/spreadable and preferably chargeable powder having the above cited particle size and to apply said powder to the detergent tablet by any suitable method, e.g. one of the methods provided below.

In one preferred embodiment the coating material comprises component A.) in an amount of 70% to 100%, particularly preferred gelatine or peptides thereof and a plasticizer in an amount of 0 to 30%.

After preparation the coating represents about 0.1% to 20%, preferably 0.2% to 15%, more preferably 0.5% to 10% of the tablet.

A preferred coating system in accordance with the invention meets one or more of the following physical parameters:

a) High suitability for coated materials (e.g. detergents) such as providing an effective barrier to the materials coated therewith and displaying compatibility with hydroscopic and caustic materials.

b) High solubility in water, for example a 0.1-1.0 g of the coating composition material of the present invention dissolves within 15 minutes, preferably within 10 minutes in a 1 L beaker of water at 40° C. when stirred at 200 r.p.m and within 20 minutes at 20° C. under the same conditions. To meet these properties the material may include a dissolubility modifying additive.

In this regard it will be appreciated that any additives are substantially water soluble or dispersible so that the overall system retains its water solubility/water dispersibility.

Step (c): Powdering Process

The powder material, preferably the charged powder can be applied to the tablet by any suitable means. In case an uncharged powder is used the powder can be contacted with the tablets e.g. by blowing, spreading, spraying or trickling the powder over the tablet or into a chamber or area where the tablet is contained, wherein in a preferred embodiment either the tablet or the powder is at least somewhat sticky. In one preferred process the powder particles are given a negative charge and then these charged particles are directed to the tablet bodies. Preferably, the powder coating operation is carried out in special spray booths. In a typical high voltage system, powder is maintained in a fluidized-bed reservoir, injected into an air stream, and carried to a charge gun where it is charged by passing through a corona discharge field. As an alternative for the dosage system e.g. a screw dosaging system or a warm dosaging system are suitable according to the invention. The charged powder is transported to the detergent material to be coated through a combination of electrostatic and aerodynamic forces. Preferably, the powder should be projected toward the tablet by aerodynamic forces so as to bring the powder particles close to the substrate where electrostatic forces then predominate and cause the particles to be deposited. Some of the powder is then held by electrostatic forces to the surface of the substrate. Therefore, the preferred powdering process involves at least the step of bringing a charged or uncharged powder in direct contact with the tablet and enabling the adhesion of the powder to the tablet. The tablet is earthed, thus it represents the positive pole with reference to the negatively charged powder.

A preferred process involves charging the powder, e.g. pure gelatine powder or gelatine powder comprising 0.01% to 20%, preferably 0.1% to 10% of a plasticizer like e.g. glycerol, with an electrode which is built into the powder spray. The tablets may be hanged in a device touching the tablets only at a very small area. Said device further provides earthing of the tablet. Alternatively the tablets may be placed on a conveyor, preferably on a conveyor belt or a conveyor having a wire or net structure. In the preferred embodiment the tablets are hanged in the device and are transported first though the powdering area, thereafter without release through the moisture/steam area explained below. The resulting powder distribution on the tablet is commonly very homogeneous, however, still can include some irregularities. It is especially advantageous that the charged powder tends to adhere to both sides of the tablet so the side opposite to the spray gun is also coated. Also, it was found that in general the adhesion between charged powder and the tablet is stronger than the adhesion between uncharged powder and the tablet. This reduces the processing time and reduces powder losses in following processing steps. Multiple spray guns or multiple runs through a single spray gun may be used if it is desired to powder a particular substrate heavily.

One suitable coating system is the gun such as the Versa Spray II IPS Automatic Powder Spray Gun with the Versa Spray II IPS 2-Gauge Control Unit & coating booth available from Nordson Corporation, Westlake, Ohio, USA are available from Nordson Corporation, Westlake, Ohio, USA. Further suitable spray systems are spraying systems offered and provided by J. Wagner GmbH, Markdorf, Germany, see http://www.wagner-group.de/portal/powder_de_wag.684360.html Step (d): Forming a Homogenous Coating, e.g. by Applying Energy and/or Moisture/Steam to the Tablet Coated with the Powder After contacting the charged dry powder with the tablet the particulate coating is transferred into a homogenous "fused" water dissolvable/dispersible coating layer (film).

By placing the tablets in a hanging device or on a conveying means during the charging process, it is found that a satisfactory spread of powder over the tablet can be obtained. It is also found that some unevenness or irregularities of distribution has no relevant effect, even if it is important for the final tablet to have a coating of substantially constant thickness, because further levelling takes place when the powder is converted in a fused homogenous film. Thus, the present invention enables a desired thickness of coating to be applied uniformly over a surface of a detergent tablet. Although the present invention involves the input of energy to convert the powder into a fused film, the amount of energy required can be substantially less than that involved in case where a liquid coating comprising a coating substance dissolved in a suitable solvent is applied and the solvent has to be vaporized after application of the coating. This is particularly important for detergent tablets, since commonly such tablets involve highly water soluble substances as well as highly temperature sensitive substances like e.g. active enzymes. Thus, neither a high amount of water or solvent load is desirable, nor subjecting the tablet to high temperatures for a long time.

According to the present invention the dry powder coating is transferred into a fused film by e.g. applying energy and/or moisture/steam (humidity) to said coating. Application of energy may be for example heat or radiation (UV, IR, microwave), further a physical or chemical reaction can occur to fuse the film. However, it is preferred to apply as less energy and moisture to the tablet as possible. In a particularly preferred embodiment energy and moisture is applied in form of steam. For this reason in one preferred embodiment of the invention the tablet after coating with the dry powder is transferred into an atmosphere comprising humidity at elevated temperatures, e.g. temperatures in the range of 20 to 150° C., preferably from 40 to 120° C., more preferably in a range not exceeding 100° C., but 60° C. can be reached. In a particular preferred embodiment the dry coating powder has a high content of at least one of the materials cited above under A.) or B.), which is e.g. a protein like gelatine and/or a sugar or amino acid(s). Such a powder coating can be rapidly transferred into a fused film by applying a humid warm atmosphere, preferably a warm atmosphere over-saturated with water, to said coating. Another possibility is to spray a very fine water fog or haze onto the tablet coated with the dry powder, preferably under elevated temperatures. Of course the amount of water/humidity which is contacted with the dry powder should not exceed the content which—optionally in combination with the applied temperature—is necessary to result in a homogenous "fused" film layer. Particularly it should be avoided to increase the water load to a level that the detergent components can react in any way with the water. It is particularly preferred that the water/humidity is added in such an amount that the content doesn't solve the coating powder (forming a solution on the surface of the tablet), but results in a swelling/expanding of the coating powder to a degree that a homogenous "fused" film layer is obtained. The amount of water preferably should be fully absorbed by the dry coating powder. In a preferred embodiment according to the invention this is obtainable by contacting the tablets coated with the powder only for 0.1 to 15 sec, preferably 1 to 10 sec, more preferably 1 to 5 sec with an atmosphere over-saturated with steam.

The parameters which can be adapted in step (d) of the present invention are: amount of energy used for "fusing" the powder to a homogenous (film) layer, amount of humidity used for "fusing" the powder to a homogenous (film) layer, time period for keeping the detergent tablets under the "fusing" conditions. These parameters can be combined in a way that the detergent compositions are affected very less and the powder coating is fused to a homogenous (film) layer. The particular conditions suitable for an effective transfer of each of any selected coating into a fused film without seriously affecting the detergent compositions can be easily found out by routine experiments.

Optional Step (a): Contacting the Tablet with a Plastifying Agent

One further possibility to improve the smoothness and flexibility and provide less brittleness to the coating is to carry out an additional optional step (a) which is contacting the tablet with a plastifying agent. In case said step (a) is carried out a plastifying agent is provided to the tablet as a separate layer, wherein said layer can be a "closed" layer or can be partially distributed on the tablet, not covering the whole surface homogenously. The plastifying agent used in this step can be of the same type(s) as the plasticizers mentioned above as well as mixtures of at least two, three or more thereof, as well as sugars, particularly low molecular weight sugars as defined above in connection with "low molecular weight compounds".

The plastifying agent(s) can be applied by any suitable means or method, e.g. by spraying a liquid or solution of the plastifying agent or applying them with a roll, or by contacting any solid plastifying agent with the tablet as well in an electrostatic field as described above.

Particularly in case a plastifying agent is brought in contact with the tablet in form of a solution or a liquid the powder coating material can be contacted thereafter immediately with the tablet without charging the powder, since the tablet itself becomes somewhat sticky by contacting it with the solution or liquid of the plastifying agent.

Optional Step (e): Cooling the Coated Tablet

After application of energy and/or moisture in step (d) the tablet can be cooled. The cooling can be carried out by blowing air, preferably cooled air over the tab or by any other suitable means. The cooling of the tablet on one hand fasten up the film forming process of the e.g. thermoplastic coating (film) layer resulting in a stabile layer, on the other hand improves the stability of the detergent components, particularly the heat sensitive components like e.g. enzymes. It is particularly pointed out that according to the invention it is not necessary to dry the coated tablet after coating, since the coating material preferably has adsorbed the whole provided content of humidity into the coating layer. Since the amount of humidity provided preferably is not so high, that the coating material is solved in the applied water (that means resulting in a solution on the surface of the tablet), but only swollen and extended to form a "fused" layer, the layer doesn't have to dried and therefore no additional heating is applied to the coated tablet.

Optional Step (f): Applying a Separating Agent to the Coated Tablet

Either after step (d) or after step (e) the tablet comprising the film layer can be contacted with a separating agent. The separating agent can reduce any remaining stickiness of the formed film layer, e.g. in case the tablet is further processed as long as the layer is not yet fully solidified. Further the separating agent may serve as protection for the film layer against air humidity or humidity of a users skin before the tablet is introduced into any liquid according to its designation.

The amount of the separating agent can be as desired, however, typically for a 20 g tablet a range of 0.01 to 1 g, preferably between 0.01 and 0.7 g is sufficient.

Such a separating agent can be each of the agents used and known in the art, preferably the separating agent is e.g. polyvinyl alcohol, polyvinyl pyrrolidone, starch, talc, zinc oxide, salts of aluminium, sugars like e.g. Isomalt, any oil or waxy particles or any other suitable agent.

While the method of the present invention will generally be applied to the coating of a tablet which have not received any coating since being formed, it may be used to apply a coating on top of an already coated or partially coated tablet as well. The method may be carried out as a continuous process. In practice there are considerable advantages in being able to operate the coating process continuously.

What is claimed is:

1. A method for preparing a coated detergent tablet, comprising the steps of:

(a) providing a powder of coating material comprising at least one film forming material and/or at least one amino acid;

(b) bringing said powder in direct contact with a detergent tablet by electrostatically charging the powder, and (c) applying moisture/steam to the tablet coated with said powder, wherein the film forming material is selected from A.) at least one water soluble or dissolvable polymer selected from the group consisting of:

A1) a protein or a peptide having a molecular weight from 20,000 to 350,000 g/mol;

A2) sugar polymers;

A3) shellac; and

A4) polyvinyl alcohol.

2. The method of claim 1 further comprising at least one of the following steps;

(d) prior to said step (a), contacting the tablet with a plastifying agent;

(e) cooling the coated tablet; and (f) applying a separating agent to the coated tablet.

3. The method of claim 1, wherein the powder further comprises at least one plasticizer.

4. The method of claim 3, wherein the plasticizer is selected from the group consisting of alkylene glycol mono lower alkyl ethers, wherein lower means $C_1$ to $C_6$, glycerol, polyalcohols, ethylene glycols, propylene glycols, polyethylene glycols, ethoxylated or propoxylated ethylene or propylene glycol or glycerol esters, glycerol triacetate, acetylated mono glycerides, triethyl citrate, tributyl citrate, acetyl triethyl citrate, acetyl tributyl citrate, diethylphthalate, glycerol carbonate, propylene carbonate and non-ionic surfactants.

5. The method of preparing a coated detergent tablet according to claim 1 wherein the coating material is swellable and water as a swelling agent is applied to the coating material attached to the tablet.

6. The method of claim 1, wherein the amino acid is a natural amino acid.

7. The method of claim 1, wherein the powder of coating material comprises a mixture of amino acids.

8. The method of claim 1, wherein the film forming material is a protein or a peptide having a molecular weight from 100,000 to 300,000 g/mol.

9. The method of claim 1, wherein the film forming material is degreased shellac.

10. The method of claim 1, wherein the powder of coating material has a particle size in the range of from 0.5 μm to 500 μm.

11. The method of claim 1, wherein the powder of coating material further comprises a low molecular sugar comprising 1 to 10 sugar units.

12. The method of claim 3, wherein the powder of coating material comprises at least 50% by weight of gelatine or peptides thereof, and 0 to 30% by weight of a plasticizer.

13. The method of claim 1, wherein said sugar polymers are selected from the group consisting of cellulose, starch, starch derivatives, and pectines.

14. The method of claim 13, wherein said pectines comprise glycogene and dextrine.

15. Detergent tablet comprising at least one layer prepared by a method comprising at least steps (b) and (c) as defined in claim 1, wherein the film forming material comprises at least 50% by weight of gelatine or peptide thereof and 0 to 30% by weight of a plasticizer.

* * * * *

UNITED STATES PATENT AND TRADEMARK OFFICE

CERTIFICATE OF CORRECTION

PATENT NO. : 8,334,249 B2
APPLICATION NO. : 12/678994
DATED : December 18, 2012
INVENTOR(S) : Belten-Casteel et al.

It is certified that error appears in the above-identified patent and that said Letters Patent is hereby corrected as shown below:

In the Specifications

In column 3 at line 40, Delete "Pyconometry." should read --Pycnometry.--.

In column 3 at line 40, Delete "Pyconometry." should read --Pycnometry.--.

In column 3 at line 43, Delete "Microneritics," should read --Micromeritics,--.

In column 3 at line 60, Delete "alcohol" should read --alcohol.--.

In column 4 at line 9, Delete "polyethyleneglycole" should read --polyethylene glycol--.

In column 4 at line 12, Delete "polyvinylalcohole" should read --polyvinyl alcohol--.

In column 4 at line 20, Delete "ethers" should read --ethers,--.

In column 7 at line 19, Delete "acyetylated" should read --acetylated--.

In column 10 at line 34, Delete ".html" should read --.html.--.

Signed and Sealed this
Thirtieth Day of July, 2013

Teresa Stanek Rea

Teresa Stanek Rea
*Acting Director of the United States Patent and Trademark Office*